US005706534A

United States Patent [19]

Sherman

[11] Patent Number: 5,706,534

[45] Date of Patent: Jan. 13, 1998

[54] PROTECTIVE BUMPER PAD

[76] Inventor: Teresa Kathleen Sherman, 1565 Prince Creek Rd., Carbonale, Colo. 81623

[21] Appl. No.: 740,239

[22] Filed: Oct. 25, 1996

[51] Int. Cl.[6] ..... A47D 7/00

[52] U.S. Cl. ..... 5/424; 5/427; 5/922; 5/946

[58] Field of Search ..... 5/424, 425, 426, 5/427, 428, 499, 500, 502, 663, 922, 946

[56] References Cited

U.S. PATENT DOCUMENTS

| | | | |
|---|---|---|---|
| 949,389 | 2/1910 | Almgren . | |
| 3,018,492 | 1/1962 | Rosen . | |
| 3,619,824 | 11/1971 | Doyle . | |
| 3,877,090 | 4/1975 | Schutz . | |
| 4,232,415 | 11/1980 | Webber | 5/427 |
| 4,370,765 | 2/1983 | Webber | 5/427 |
| 4,670,923 | 6/1987 | Gabriel et al. . | |
| 4,783,864 | 11/1988 | Turner | 5/425 |
| 5,010,611 | 4/1991 | Mallett . | |
| 5,241,718 | 9/1993 | Pope . | |
| 5,410,765 | 5/1995 | Dicken . | |
| 5,542,135 | 8/1996 | Ozrovitz et al. | 5/946 |

*Primary Examiner*—Rodney M. Lindsey
*Assistant Examiner*—Robert G. Santos
*Attorney, Agent, or Firm*—Charles J. Prescott

[57] ABSTRACT

A protective bumper pad for an infant crib. The bumper pad includes an elongated flexible generally flat member having a length generally equal to the interior perimeter of the crib just above the crib mattress and formed of substantially coextensive padded and unpadded sections separated by a longitudinally extending flexible fold line. The unpadded section includes an elastic edge which defines a longitudinal edge of the bumper pad, the elastic edge, when relaxed, being substantially shorter than the length of the padded section. The ends of the bumper pad are releasably connectable together when the device is positioned against the inside perimeter of the crib and flexible spaced apart ties connected on the outwardly facing surface of the padded section connectable to upright slats of the sides of the crib retain the upright positioning of the padded section. The unpadded section is positioned beneath the crib mattress, positioning being facilitated by the elastic edge. The cross sections of the padded and unpadded sections are each generally uniform throughout the length of the bumper pad so as to easily flexibly conform to a variety of crib interior perimeters.

6 Claims, 4 Drawing Sheets

PROTECTIVE BUMPER PAD

BACKGROUND OF THE INVENTION

1. Scope of Invention

This invention relates generally to baby cribs, and more particularly to a conveniently and securably installable crib bumper pad to protect the infant from body impact against the sides of a wide variety of differently shaped baby cribs.

2. Prior Art

Baby or infant cribs typically include a horizontal mattress support surface for a mattress and upright side and end panels or rails that extend upwardly from the mattress support surface. The side and end panels are typically formed of upright spaced slats for easy viewing of the infant. One of the side panels is typically segmented so that the upper portion thereof may be lowered for easy access in placing or lifting the infant.

However, these side and end panels, usually fabricated of wood or plastic material may seriously injure or bruise the infant and, in extreme circumstances, may trap the infant's head or a limb between two adjacent slats.

A number of patented prior art devices are known to applicant which have attempted to address these problems which endanger infants by providing a padded member which is positioned against substantially all of the interior perimeter of the baby crib just above the surface of the mattress as follows:

| | |
|---|---|
| 949,389 | Almgren |
| 3,018,492 | Rosen |
| 3,619,824 | Doyle |
| 3,877,090 | Schutz |
| 4,670,923 | Gabriel, et al. |
| 5,010,611 | Mallett |
| 5,241,718 | Pope |
| 5,410,765 | Dicken |

The present invention improves upon these prior art devices by providing an economical to manufacture flexible bumper pad for the interior perimeter of an infant's crib which is easily installable and retained from movement primarily by the weight of the mattress of the crib. By its preferred substantially uniformly sectioned flexible nature, the invention will also adapt to various sizes and shapes of baby cribs, including those which do not include orthogonal corners or any corners whatsoever.

BRIEF SUMMARY OF THE INVENTION

This invention is directed to a protective bumper pad for an infant crib. The bumper pad includes an elongated flexible generally flat member having a length generally equal to the interior perimeter of the crib just above the crib mattress and formed of substantially coextensive padded and unpadded sections separated by a longitudinally extending flexible fold line. The unpadded section includes an elastic edge which defines a longitudinal edge of the bumper pad, the elastic edge, when relaxed, being substantially shorter than the length of the padded section. The ends of the bumper pad are releasably connectable together when the device is positioned against the inside perimeter of the crib and flexible spaced apart ties connected on the outwardly facing surface of the padded section connectable to upright slats of the sides of the crib retain the upright positioning of the padded section. The unpadded section is positioned beneath the crib mattress, positioning being facilitated by the elastic edge. The cross sections of each of the padded and unpadded sections are each generally uniform throughout the length of the bumper pad so as to easily conform to a variety of crib interior perimeters.

It is therefore an object of this invention to provide a protective bumper pad for infant cribs which prevents infants from impacting with or reaching through and becoming entrapped between the slats and hard surfaces of the interior perimeter of an infant crib.

It is still another object of this invention to provide a protective bumper pad for infant cribs which is economically manufacturable by having a substantially uniform cross section over substantially its entire length.

It is yet another object of this invention to provide a protective bumper pad for an infant crib which is easily deployable and secured in position from substantial movement by flexible ties and the weight of the crib mattress.

It is still another object of this invention to provide a protective bumper pad which will flexibly accommodate a broad variety of infant crib shapes as well as conventional rectangular cribs.

In accordance with these and other objects which will become apparent hereinafter, the instant invention will now be described with reference to the accompanying drawings.

DETAILED DESCRIPTION OF THE INVENTION

Figure 1:
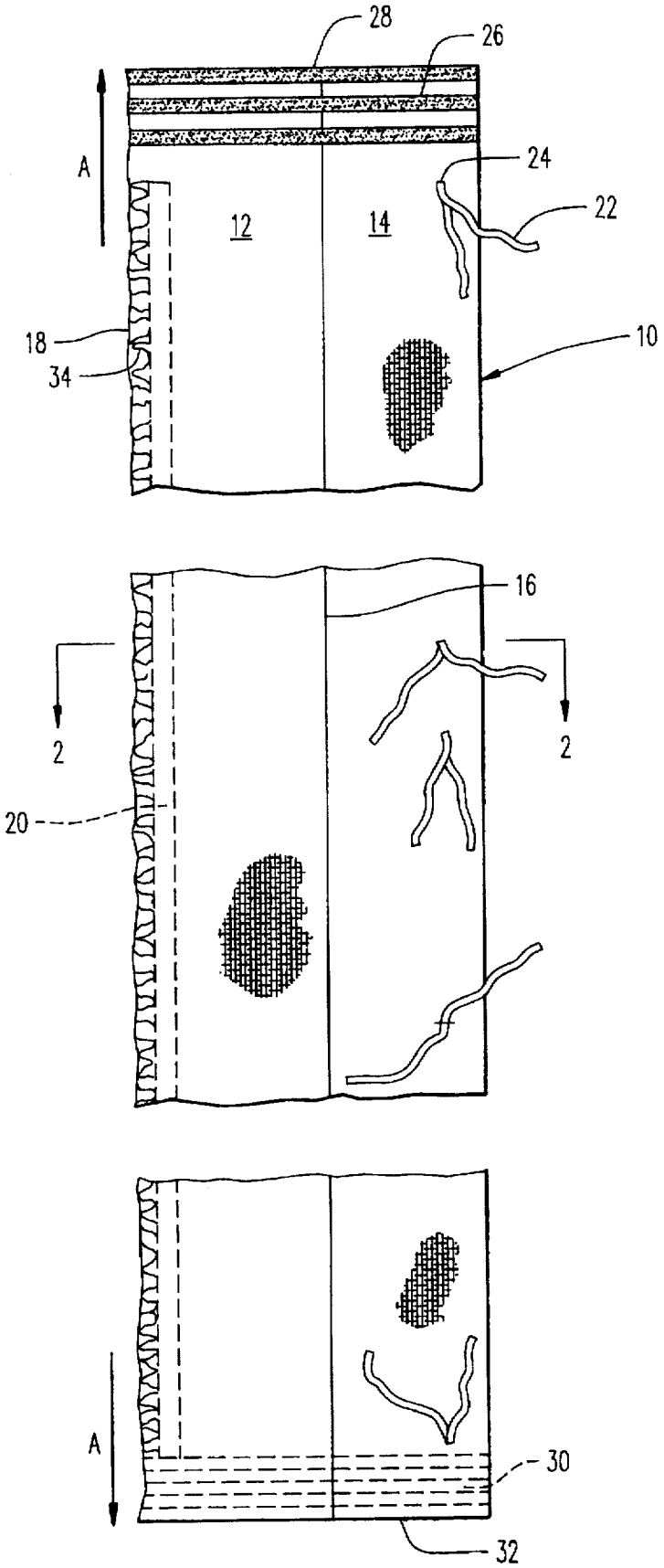
FIG. 1 is a plan view in the flat of the invention.
Figure 2:
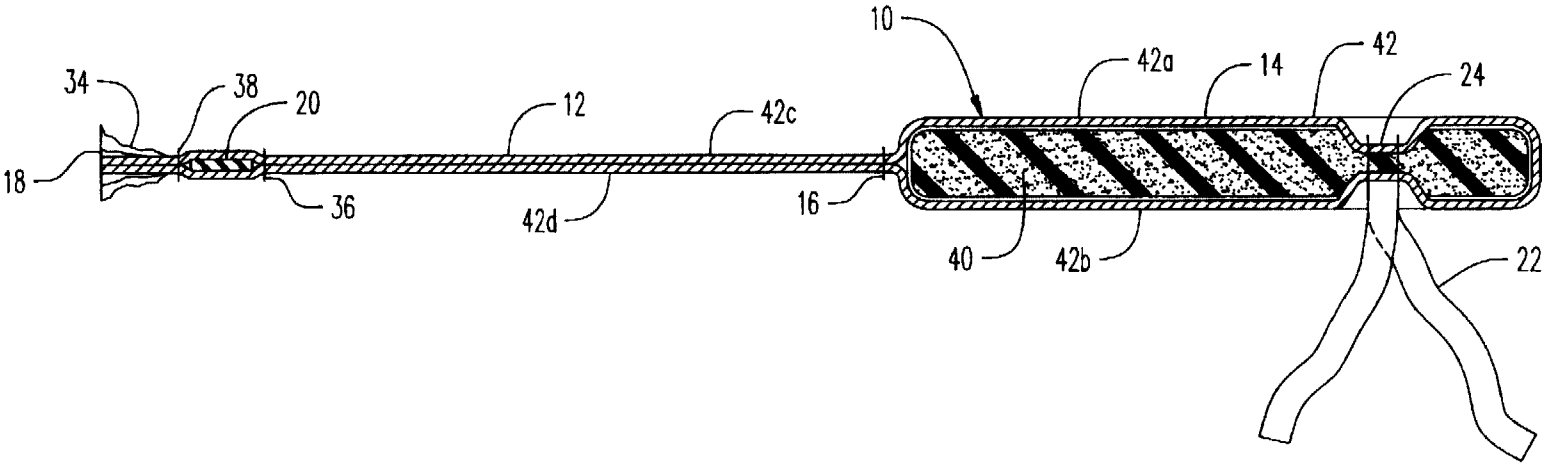
FIG. 2 is a cross section view in the direction of arrows 2—2 in FIG. 1.

Referring now to the drawings, and particularly to FIGS. 1 and 2, the invention in its preferred embodiment is shown generally at numeral 10 and includes substantially coextensive unpadded and padded sections 12 and 14, respectively. The padded section 14 includes an inner layer of flexible foam or foam rubber or the like 40 which is covered or enclosed by a sheet of flexible fabric material 42 which covers both surfaces **42*a* and 42*b* of the padding material 40 and is stitched together at 16 along the entire length of the bumper pad 10 so as to form a flexible fold line therealong. The sheet of flexible fabric material 42 extends at 42*c* and 42*d* beyond the stitched fold line 16 to form and define the unpadded section 12**.

Extending lengthwise adjacent substantially the entire length of the edge 18 of the unpadded section 12 is a length of elastic material 20. This elastic material 20 is held in position between lengthwise stitching 36 and 38 and is sized in length so that, when in a relaxed configuration, it is substantially shorter in length than the overall length of the bumper pad 10. When elastically reduced, the edge 18 of the unpadded section 12 draws into a series of folds 34 to accommodate the elastic shortening arrangement. Thus, by pulling the ends of the edge 18 in the direction of arrows A, the elastic member 20 is stretched to a maximum length of edge 18 equal to the overall length of the bumper pad 10.

Figure 3:
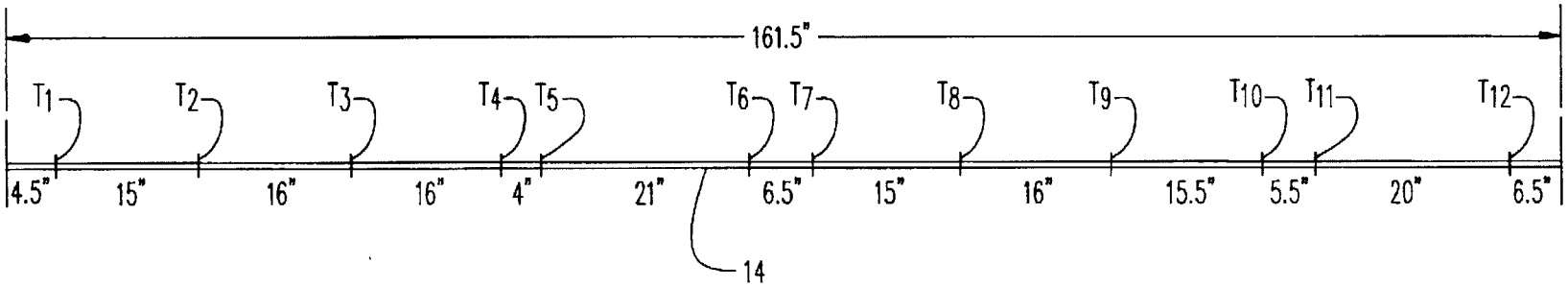
FIG. 3 is a simple schematic view of the padded section of the invention showing the preferred positioning of the flexible ties along the length of the device.

A series of spaced fabric ties 22 are sewn into the outwardly facing surface of padded section 14 at 24. As best seen in FIG. 3, these flexible ties 22 are spaced at Tl–T12 in the spaced relationship shown along the entire length of the padded member 14. This dimensional spacing arrangement of the ties Ti–T12 is selected to accommodate a conventionally sized rectangular baby crib for attachment to upright slats described herebelow.

The bumper pad 10 includes spaced mating transversely oriented two-part hook and loop strips 26 and 30 attached adjacent each end 28 and 32. The pile covered strips 26 are positioned on the outwardly facing surface of the bumper pad 10 and facing in the same direction as the flexible ties 22. The loop covered strips 30 are positioned on the inner facing surface of the bumper pad 10. This arrangement is provided so that, when the ends 28 and 32 are brought in overlapping fashion and connected together, should any of the pile covered strips 26 face inwardly, they will provide a softer surface against which the baby within the infant crib might come in contact.

Figure 4:
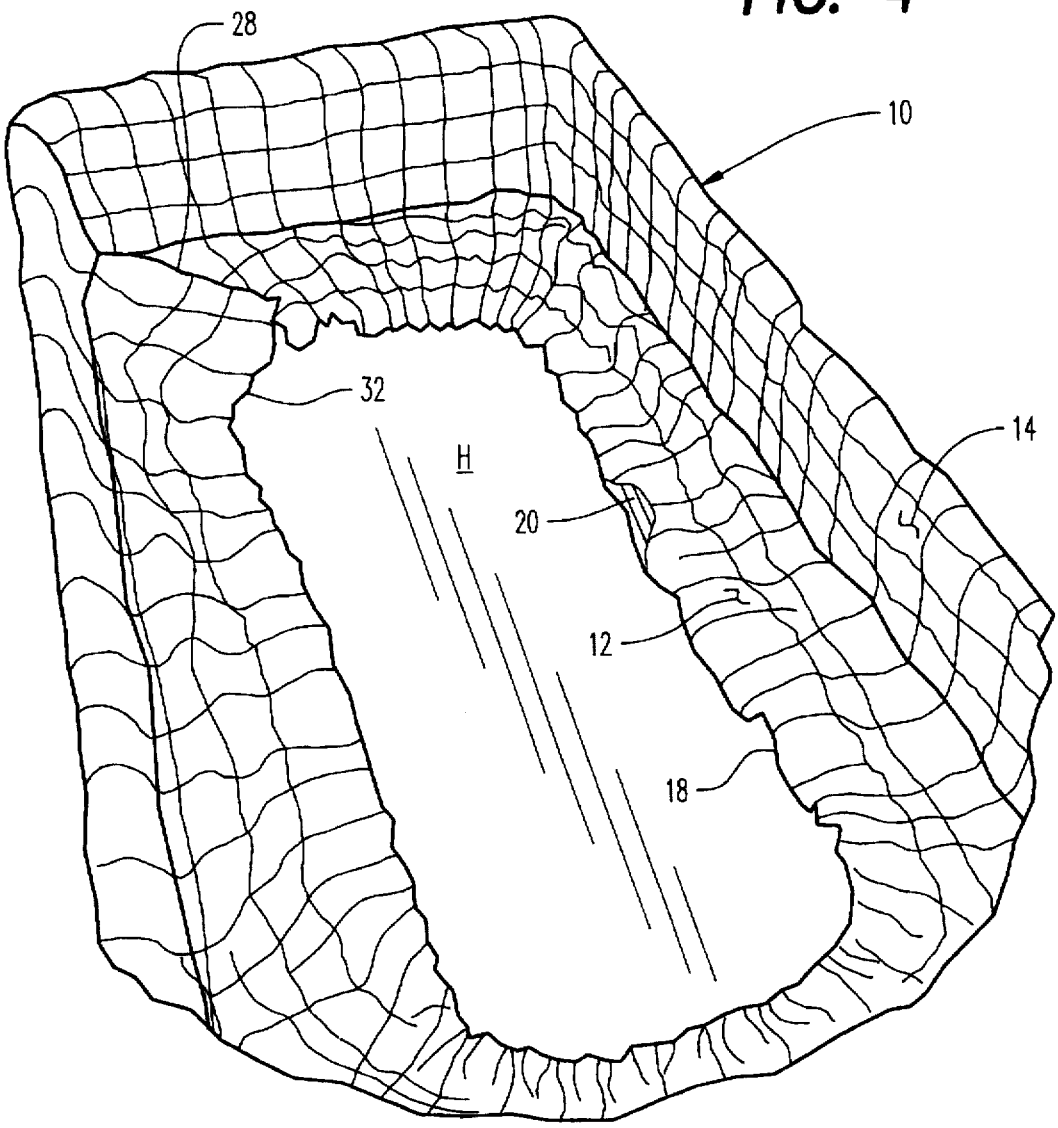
FIG. 4 is a perspective broken view of the invention in position absent the infant crib for clarity.
Figure 5:
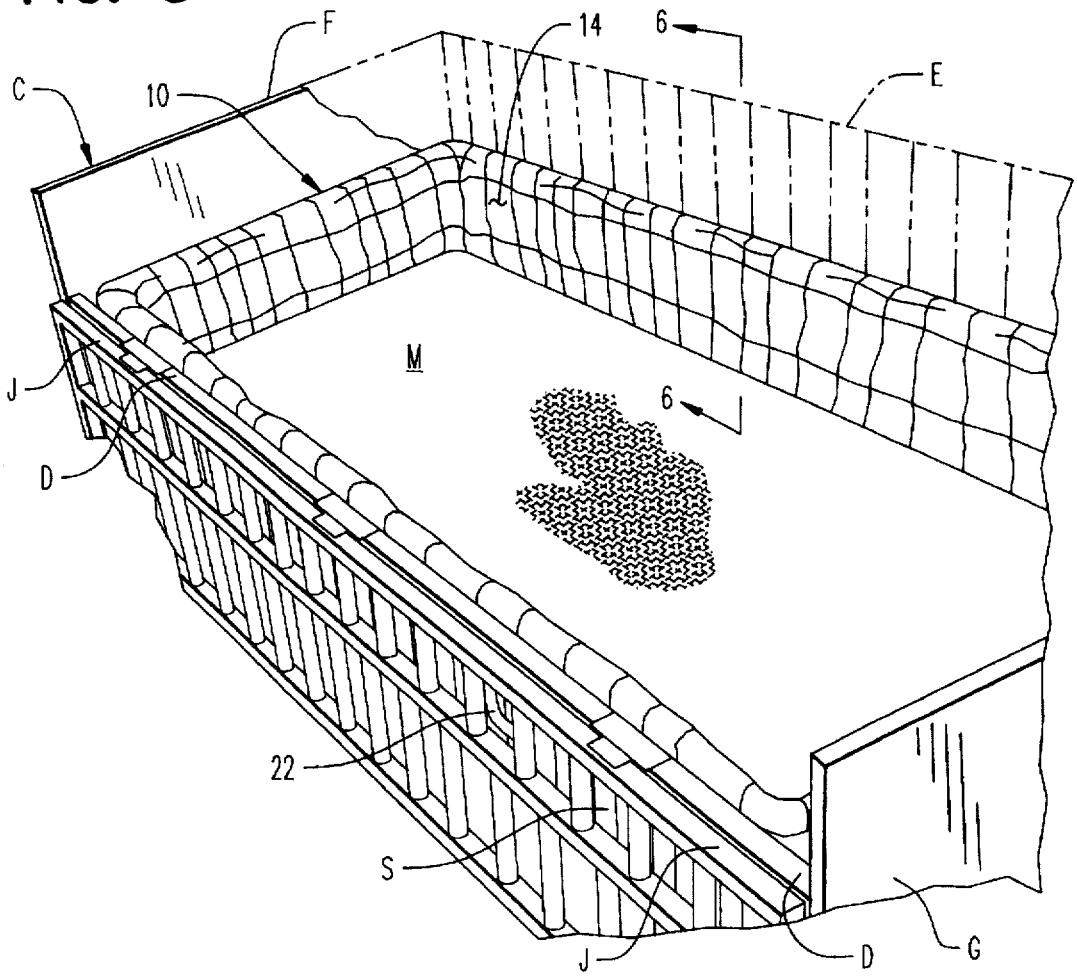
FIG. 5 is a perspective view similar to FIG. 4 depicting the relationship of the components of the infant crib associated therewith.
Figure 6:
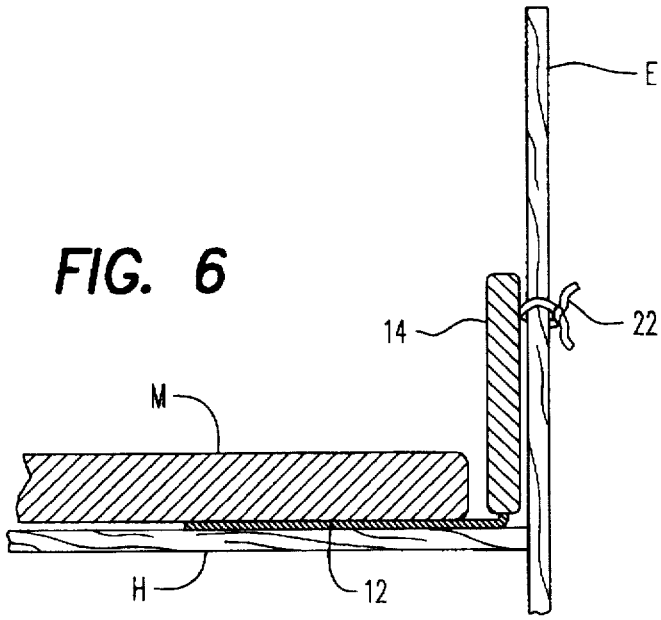
FIG. 6 is a section view in the direction of arrows 6—6 in FIG. 5.

Referring now additionally to FIGS. 4, 5 and 6, the invention 10 shown in FIG. 4 is absent the components of the infant crib, except for the horizontal mattress support surface H, for clarity. When properly deployed, the overlapping ends 28 and 32 are releasably attached to one another by the mating hook and pile covered strip materials 26 and 30 previously described with the padded section 14 which is positioned uprightly against the interior perimeter of the crib. The hidden elastic member 20 in its relaxed configuration being substantially shorter than the overall length of the bumper pad 10 facilitates the shortening of margin 18 so that the unpadded section 12 will more easily be disposed generally inward orthogonal to the upright padded section 12 and will lay generally flat atop the horizontal mattress support surface H.

Once the bumper pad 10 is positioned as shown in FIG. 4, the mattress M as seen in FIGS. 5 and 6 is placed atop the unpadded section 12 to prevent inadvertent upward movement of the padded section 14. Ties 22 (typ.) are each wrapped around a correspondingly aligned upright slat or spindle S of the side rails D and E. Typically, a conventional baby crib shown generally at C also includes one side rail J which is positionable downwardly for easier access into the crib. Solid headboards F and G disposed at each end of the crib C in lieu of slotted end panels are shown.

Figure 7:
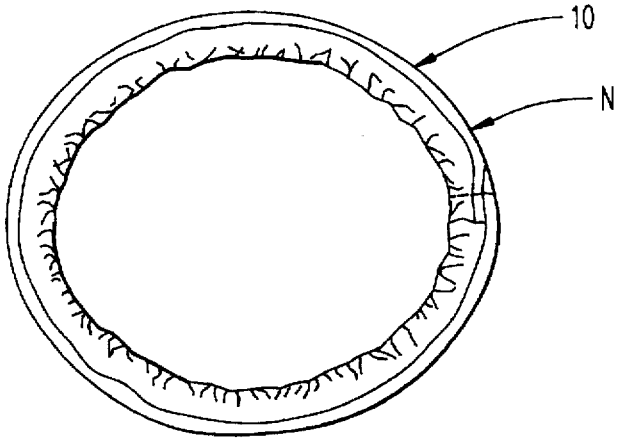
FIG. 7 is a top plan schematic view of the invention in position within an oval-shaped infant crib.

Referring now to FIG. 7, because the bumper pad 10 has a substantially uniform cross section of each of the padded and unpadded sections 14 and 12, respectively, along substantially the entire length thereof, the bumper pad 10 will easily flexibly conform to a variety of plan view shapes of baby cribs. In FIG. 7, an oval shaped crib N is there shown in schematic form as such an example.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A protective bumper pad for an infant crib of the type having a horizontal support panel, a mattress sized to substantially cover and rest atop the horizontal support panel, and side rails having slats extending upwardly from the horizontal support panel, said protective pad comprising:

an elongated generally flat flexible member having two ends and a length for being substantially equal to an interior perimeter of the crib and formed of substantially coextensive padded and unpadded sections separated by a longitudinal flexible fold line therebetween;

said unpadded section including a generally coextensive elastic edge whereby, when relaxed, said elastic edge of said unpadded section is substantially shorter in length than that of said padded section;

means for releasably connecting each end of said flexible member together;

a plurality of flexible, elongated ties each connected in spaced relation along an outwardly facing surface of said padded section whereby, with the mattress removed, when said padded section is positioned uprightly against the entire interior perimeter of the crib and said ends of said flexible member are releasably connected together and said unpadded section is laid substantially flat atop the horizontal support panel, each said tie being then securable to a corresponding slat of the side rail, the mattress being thereafter positionable atop the horizontal support panel and said unpadded section thereby preventing substantially upward movement of said padded section.

2. A protective bumper pad as set forth in claim 1, wherein:

said padded and unpadded sections are generally uniform and about equal in width.

3. A protective bumper pad as set forth in claim 1, wherein:

said padded and unpadded sections are each substantially uniform in cross section over substantially the entire length of said flexible member whereby said bumper pad will flexibly conform to a variety of infant crib interior perimeter shapes.

4. A protective bumper pad for an infant crib of the type having a horizontal support panel, a mattress sized to substantially cover and rest atop the horizontal support panel, and side rails having slats extending upwardly from the horizontal support panel, said protective pad in the flat comprising:

an elongated flexible member having two ends and a length for being substantially equal to an interior perimeter of the crib and formed of substantially coextensive padded and unpadded sections separated by a longitudinal flexible fold line therebetween;

said unpadded section including a generally coextensive elastic edge whereby, when relaxed, said elastic edge of said unpadded section is elastically contracted in length to be substantially shorter than a length of said padded section;

means for releasably connecting each end of said flexible member together;

a plurality of flexible, elongated ties each connected in spaced relation along an outwardly facing surface of said padded section, each said tie being alignable and securable to a corresponding slat of the side rail when said bumper pad is properly installed into the crib.

5. A protective bumper pad as set forth in claim 4, wherein:

said padded and unpadded sections are generally uniform and about equal in width.

6. A protective bumper pad as set forth in claim 4, wherein:

said padded and unpadded sections are each substantially uniform in cross section over substantially the entire length of said flexible member whereby said bumper pad will flexibly conform to a variety of infant crib interior perimeter shapes.

* * * * *